US011285078B2

(12) United States Patent
Henderson

(10) Patent No.: US 11,285,078 B2
(45) Date of Patent: Mar. 29, 2022

(54) MEDICATION HOLDING DEVICE

(71) Applicant: Wesley Henderson, Newburgh, IN (US)

(72) Inventor: Wesley Henderson, Newburgh, IN (US)

( * ) Notice: Subject to any disclaimer, the term of this patent is extended or adjusted under 35 U.S.C. 154(b) by 528 days.

(21) Appl. No.: 16/008,126

(22) Filed: Jun. 14, 2018

(65) Prior Publication Data

US 2019/0380908 A1 Dec. 19, 2019

(51) Int. Cl.
*A61J 1/16* (2006.01)
*A61J 1/20* (2006.01)

(52) U.S. Cl.
CPC ..... *A61J 1/16* (2013.01); *A61J 1/2096* (2013.01)

(58) Field of Classification Search
CPC ..... A61J 1/16; A47F 7/28; A47F 5/08
See application file for complete search history.

(56) References Cited

U.S. PATENT DOCUMENTS 1,980,930 A * 11/1934 Reyniers ..... B01L 9/06 211/74
2,371,433 A * 3/1945 Davis ..... B25H 3/04 211/70.6
3,521,332 A * 7/1970 Kramer ..... F16B 2/22 403/188
5,657,882 A * 8/1997 Johnson ..... A47B 81/005 211/68
9,907,727 B2 * 3/2018 Sharpe ..... A61J 1/16
2011/0031199 A1 * 2/2011 Tobey ..... A61J 1/16 211/131.1

OTHER PUBLICATIONS

TERRY Tool Clips-Closed Type. May 25, 2012, accessed Aug. 30, 2021. Internet Archive [https://web.archive.org/web/20120525044036/https://www.autopartswholesalers.com.au/products/fixing-ret (Year: 2012).*

* cited by examiner

*Primary Examiner* — Leslie R Deak
(74) *Attorney, Agent, or Firm* — Taylor English Duma LLP

(57) ABSTRACT

Example aspects of a medication holding device and a method for using a medication holding device are disclosed. The medication holding device can comprise a mount and a grip coupled to the mount, the grip defining a channel, the grip movable between an open position and a closed position, the channel defining a first width in the closed position, the channel defining a second width in the open position that is greater than the first width.

20 Claims, 5 Drawing Sheets

MEDICATION HOLDING DEVICE

TECHNICAL FIELD

This disclosure relates to medical devices. More specifically, this disclosure relates to a device for holding containers of medication.

BACKGROUND

Medical professionals are often required to draw medication from containers, such as vials. Commonly, a first medical professional holds the vial and a second medical professional draws the medication from the vial with a syringe. In another common circumstance, a medical professional holds the vial in one hand and draws the medication from the vial with his/her other hand. Thus, the process of drawing medication from a vial often can require the attention of two medical professionals at once.

In drawing the medication, a needle of the syringe is inserted into the vial. Needlestick injuries can occur when the needle punctures the hand of a medical professional holding the vial. In instances where the medical professional is stuck with a contaminated needle, the medical professional's health can be compromised. In other instances, a sterile needle can be contaminated by touching or puncturing the medical professional's hand. Administering medication to a patient with a contaminated needle can compromise the health of the patient.

Moreover, in instances where it is required to administer multiple medications from multiple vials, it can be difficult for the medical professional(s) to handle and keep track of the multiple vials and needles.

Furthermore, different vials can be different sizes and shapes. Devices for holding the vials often do not accommodate for varying sizes and shapes of vials.

SUMMARY

It is to be understood that this summary is not an extensive overview of the disclosure. This summary is exemplary and not restrictive, and it is intended neither to identify key or critical elements of the disclosure nor delineate the scope thereof. The sole purpose of this summary is to explain and exemplify certain concepts off the disclosure as an introduction to the following complete and extensive detailed description.

Disclosed is a medication holding device comprising a mount and a grip coupled to the mount, the grip defining a channel, the grip movable between an open position and a closed position, the channel defining a first width in the closed position, the channel defining a second width in the open position that is greater than the first width.

Also disclosed is a medication holding device comprising a mount comprising a support panel, a rail coupled to the support panel, and a clamp coupled to the rail, the clamp comprising a spring, a pair of clamp halves, and a tab extending from a first one of the clamp halves, the spring biasing the clamp halves towards one another, the clamp halves defining a channel therebetween, an axle extending through the spring, the clamp halves pivotably coupled to the axle and movable between an open position and a closed position.

Also disclosed is a method for using a medication holding device comprising the steps of applying a twisting force to a spring of a spring-loaded clamp, inserting a vial into a channel of the clamp, releasing the twisting force on the spring, inserting a needle of a syringe into the vial, and drawing medication from the vial.

Various implementations described in the present disclosure may include additional systems, methods, features, and advantages, which may not necessarily be expressly disclosed herein but will be apparent to one of ordinary skill in the art upon examination of the following detailed description and accompanying drawings. It is intended that all such systems, methods, features, and advantages be included within the present disclosure and protected by the accompanying claims.

BRIEF DESCRIPTION OF THE DRAWINGS

The features and components of the following figures are illustrated to emphasize the general principles of the present disclosure. Corresponding features and components throughout the figures may be designated by matching reference characters for the sake of consistency and clarity.

DETAILED DESCRIPTION

Figure 1:
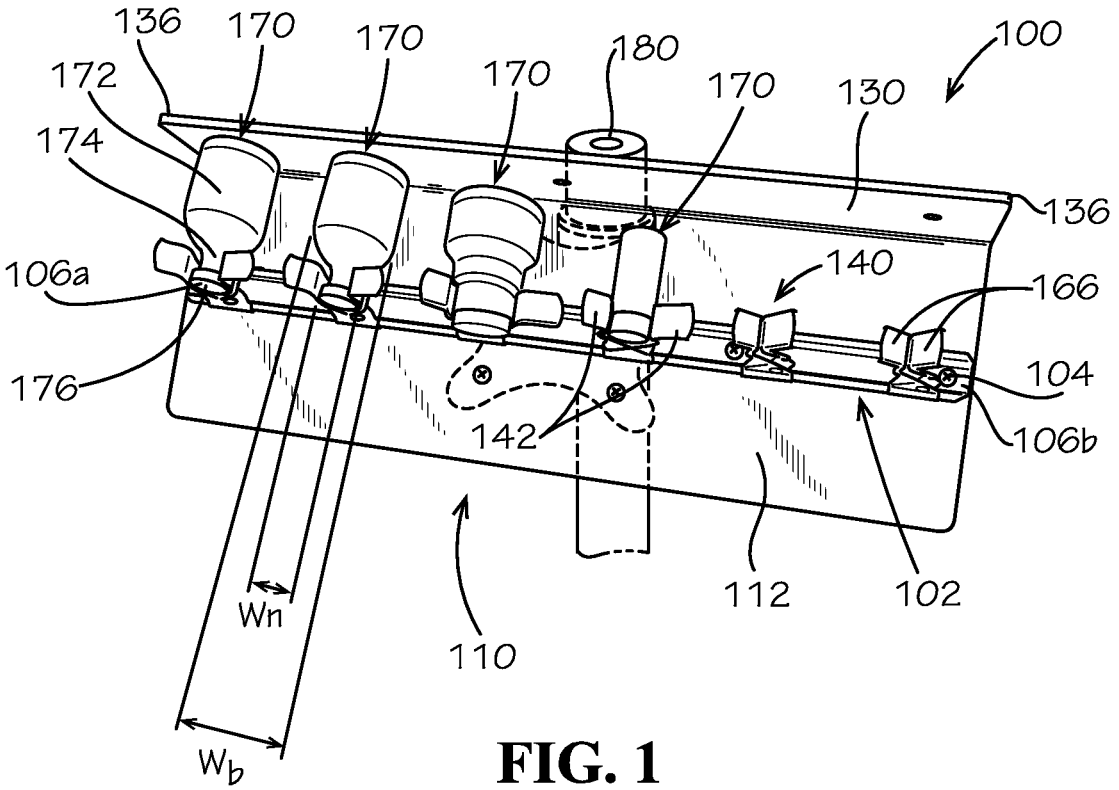
FIG. 1 shows a perspective view of a medication holding device comprising a grip and a mount, in accordance with one aspect of the present disclosure.

The present disclosure can be understood more readily by reference to the following detailed description, examples, drawings, and claims, and the previous and following description. However, before the present devices, systems, and/or methods are disclosed and described, it is to be understood that this disclosure is not limited to the specific devices, systems, and/or methods disclosed unless otherwise specified, and, as such, can, of course, vary. It is also to be understood that the terminology used herein is for the purpose of describing particular aspects only and is not intended to be limiting.

The following description is provided as an enabling teaching of the present devices, systems, and/or methods in its best, currently known aspect. To this end, those skilled in the relevant art will recognize and appreciate that many changes can be made to the various aspects of the present devices, systems, and/or methods described herein, while still obtaining the beneficial results of the present disclosure. It will also be apparent that some of the desired benefits of the present disclosure can be obtained by selecting some of the features of the present disclosure without utilizing other features. Accordingly, those who work in the art will recognize that many modifications and adaptations to the present disclosure are possible and can even be desirable in certain circumstances and are a part of the present disclosure. Thus, the following description is provided as illustrative of the principles of the present disclosure and not in limitation thereof.

As used throughout, the singular forms "a," "an" and "the" include plural referents unless the context clearly dictates otherwise. Thus, for example, reference to "an element" can include two or more such elements unless the context indicates otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

For purposes of the current disclosure, a material property or dimension measuring about X or substantially X on a particular measurement scale measures within a range between X plus an industry-standard upper tolerance for the specified measurement and X minus an industry-standard lower tolerance for the specified measurement. Because tolerances can vary between different materials, processes and between different models, the tolerance for a particular measurement of a particular component can fall within a range of tolerances.

As used herein, the terms "optional" or "optionally" mean that the subsequently described event or circumstance can or cannot occur, and that the description includes instances where said event or circumstance occurs and instances where it does not.

The word "or" as used herein means any one member of a particular list and also includes any combination of members of that list. Further, one should note that conditional language, such as, among others, "can," "could," "might," or "may," unless specifically stated otherwise, or otherwise understood within the context as used, is generally intended to convey that certain aspects include, while other aspects do not include, certain features, elements and/or steps. Thus, such conditional language is not generally intended to imply that features, elements and/or steps are in any way required for one or more particular aspects or that one or more particular aspects necessarily include logic for deciding, with or without user input or prompting, whether these features, elements and/or steps are included or are to be performed in any particular aspect.

Disclosed are components that can be used to perform the disclosed methods and systems. These and other components are disclosed herein, and it is understood that when combinations, subsets, interactions, groups, etc. of these components are disclosed that while specific reference of each various individual and collective combinations and permutation of these may not be explicitly disclosed, each is specifically contemplated and described herein, for all methods and systems. This applies to all aspects of this application including, but not limited to, steps in disclosed methods. Thus, if there are a variety of additional steps that can be performed it is understood that each of these additional steps can be performed with any specific aspect or combination of aspects of the disclosed methods.

Disclosed in the present application is a medication holding device and associated methods, systems, devices, and various apparatus. Example aspects of the medication holding device can comprise a grip for engaging a medication container and a mount for supporting the grip. It would be understood by one of skill in the art that the disclosed medication holding device is described in but a few exemplary aspects among many. No particular terminology or description should be considered limiting on the disclosure or the scope of any claims issuing therefrom.

FIG. 1 illustrates a first aspect of a medication holding device 100 according to the present disclosure. The medication holding device 100 can comprise a mount 110 and one or more grips 140 attached to the mount 110. The grip 140 can be, for example, a spring-loaded clamp 140, as shown. Each of the clamps 140 can be configured to grip a container, such as a vial 170, containing medication. According to example aspects, each clamp 140 can comprise a pair of clamp halves 142 and a spring 444 (shown in FIG. 4) biasing the pair of clamp halves 142 towards a closed position. In example aspects, an elongated tab 166 can extend from each of the clamp halves 142. In other aspects, an elongated tab 166 can extend from only one of the clamp halves 142. In some aspects, the clamp halves 142 can be formed from a metal material, such as, for example, steel. In other example aspects, the clamp halves 142 can be formed from another material, such as, for example, plastic, glass, wood, another metal material, resin, synthetic materials and fibers, or any other suitable material or combination of materials. Moreover, in other aspects, the grip 140 can be formed as or can utilize band clamps, c-clamps, various types of clips, magnets, elastic bands, straps, or another device known in the art that can be suitable for engaging a vial 170 or other medication container. In still other aspects, the clamp halves 142 can be integrally or monolithically formed and can comprise a flexible but resilient material that can bias the clamp halves 142 closed and can allow the clamp halves 142 to be pried open for insertion of the vial 170.

According to example aspects, the mount 110 can comprise a support panel 112 and a backboard 130 extending from the support panel 112. In example aspects, the support panel 112 and backboard 130 can be integrally formed as a single monolithic structure, and can be defined as planar structures. In other aspects, the support panel 112 and backboard 130 can be formed as separate components. As shown, the one or more of the spring-loaded clamps 140 can be attached to and supported by the support panel 112. Some example aspects of the mount 110 can be coupled to a support 180 for supporting the medication holding device 100. The support panel 112 and backboard 130 can be formed from a plastic material, such as, for example, an acrylic plastic material that in some aspects can be transparent. Other aspects of the support panel 112 and backboard 130 can be formed from another material, such as metal, glass, wood, resin, synthetic materials and fibers, or any other suitable material or combination of materials. Further, other aspects of the mount 110 do not comprise a backboard 130. According to example aspects, the backboard 130 can define a pair of opposing corners 136 distal from the support panel 112.

As shown, example aspects of the medication holding device 100 can comprise a rail 102 for mounting the clamps 140 to the mount 110. The rail 102 can be secured to the mount 110 by a fastener, such as, for example, one or more screws 104. In other aspects, the fastener can comprise a nail, adhesive, etc., or any other suitable fastener known in the art. The rail can define a pair of opposing rail ends 106*a,b*. The clamps 140 can be spaced apart along the rail 102, and in example aspects, the clamps 140 can be selectively repositionable along the rail 102 as desired by a manufacturer or a user. Moreover, according to example aspects, the clamps 140 can be selectively detachable from the rail 102, such that clamps 140 can be added or removed, as desired. Thus, the medication holding device 100 can be customized to accommodate for different sizes of vials 170 that may require more or less space by allowing for adjustment in the space between adjacent clamps 140. Further, the medication holding device 100 can be customized to accommodate for varying quantities of vials 170, as certain patients may require more or fewer medications, by allowing for the selective attachment and detachment of clamps 140. Example aspects of the rail 102 can be formed from metal, such as steel. Other example aspects of the rail 102 can be formed from another material, such as, for example, plastic, glass, wood, another metal material, resin, synthetic materials and fibers, or any other suitable material or combination of materials. In other aspects, the rail 102 need not be present and the clamps 140 can be directly fastened to the mount 110.

According to example aspects, as shown in FIG. 1, each vial 170 can comprise a vial body 172 and a vial neck 174. Other example aspects of the vial 170 can comprise a body 172 and no neck 174. The neck 174 and body 172 can define an interior cavity (not shown) for containing a medication. According to some example aspects, the neck 174 can define a width $W_n$ that can be less than a width $W_b$ of the body 172, while in other aspects, the neck 174 and body 172 can define approximately equal widths. Further, different vials 170 can have different dimensions, and the clamps 140 can thus be configured to hold a range of different-sized vials 170. The neck 174 can define an opening (not shown) that can allow access to the cavity. Further, in example aspects, the vial 170 can comprise a stopper (not shown) that can be positioned at the opening of the neck 174 to prevent leaking of the contained medication. Example aspects of the stopper can be formed from cork, plastic, rubber, or another suitable material known in the art. Additionally, example aspects of the vial 170 can comprise a cap 176 for securing the stopper to the vial 170. A needle of a syringe (not shown) can be inserted through the stopper and into the cavity to draw medication from the vial 170.

According to example aspects, as shown, each of the clamps 140 can be configured to removably engage the neck 174 of the vial 170. In other aspects, the clamp 140 can engage the body 172 of the vial 170. When engaged by the clamp 140, the vial 170 can be oriented in a generally inverted position, such that the body 172 can be elevated above the stopper, relative to the orientation shown. In some aspects, the vial 170 can be oriented such that the body 172 and the stopper can be generally vertically aligned, and in other aspects, the vial 170 can be tilted relative to vertical, with the body 172 still elevated above the stopper. The orientation can depend on the comfort and preference of the user, as well as other factors such as the height or position of the patient or the layout and dimensions of surrounding medical equipment. Orienting the body 172 of the vial 170 above the stopper can allow gravity to move the medication contained within the vial 170 towards the stopper, where the needle of the syringe can be inserted. With the vials 170 stably supported by the medication holding device 100, a sole medical professional can easily access and withdraw medication from multiple vials 170 without needing to hold the vials 170 by hand or requiring a second medical professional to hold the vials 170. Thus, the medical professional withdrawing the medications can perform the task quicker and more safely, and the second medical professional can be free to do other work.

Figure 2:
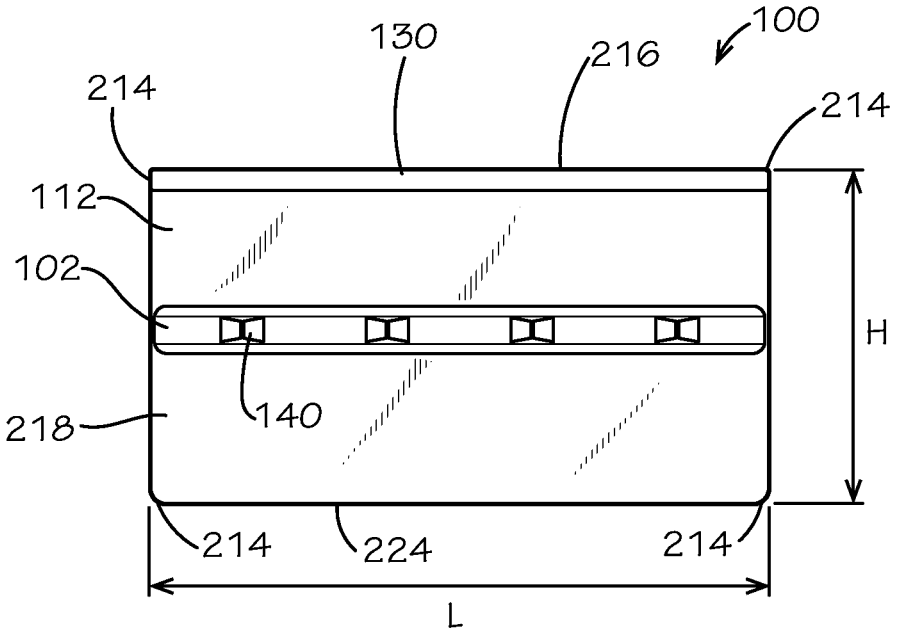
FIG. 2 is a front view of the medication holding device of FIG. 1.

FIG. 2 illustrates a front view of the medication holding device 100. As shown, in example aspects, the support panel 112 can define a generally rectangular shape defining four corners 214. Other aspects of the support panel 112 can define another shape, such as, for example, square, oval, circular, etc. As shown, in some aspects, the corners 214 of the support panel 112 can be rounded. The support panel 112 can further define a top edge 216, a bottom edge 224, and central section 218 between the top and bottom edges 216, 224. References to top, bottom, front, back, above, and below in this disclosure can be relative to the orientations shown. The backboard 130 can extend from the top edge 216 of the support panel 112 and can span a length L of the support panel 112. The rail 102 can be coupled to the central section 218 of the support panel 112 and can span the length L of the support panel 112. Other example aspects of the rail 102 can be coupled to the support panel 112 adjacent the bottom edge 224. As shown, according to example aspects, the length L of the support panel 112 can approximately equal a length of the backboard 130 and a length of the rail 102. Example dimensions of the length L of the support panel 112, backboard 130, and rail 102 can be between approximately 10 and 25 inches, and more specifically can be between approximately 15 and 20 inches. In one example aspect, the length L can be approximately 17.25 inches. Example dimensions of a height H of the support panel 112 can be between approximately 2 and 10 inches, and more specifically can be between approximately 4 and 8 inches. In one example aspect, the height H can be approximately 6 inches.

Figure 3:
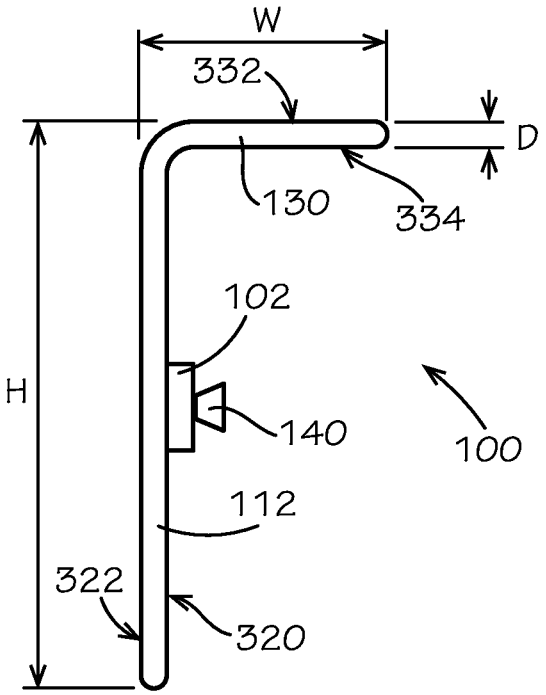
FIG. 3 is a side view of the medication holding device of FIG. 1.

FIG. 3 illustrates a side view of the medication holding device 100. As shown, the support panel 112 can define a front surface 320 and an opposite back surface 322. According to example aspects, each of the front and back surfaces 320, 322 can be generally planar and can be generally parallel to one another. The rail 102 can be attached to the front surface 320 of the support panel 112, and the backboard 130 can extend from the front surface 320 of the support panel 112. Moreover, the backboard 130 can define top and bottom surfaces 332, 334 that can be generally planar and generally parallel to one another. Example aspects of the backboard 130 can define a generally rectangular shape comprising rounded corners 136 (shown in FIG. 1). As shown, the backboard 130 can extend from the top edge 216 of the support panel 112 in a direction generally perpendicular to the height H of the support panel 112. Example dimensions of a width W of the backboard 130 can be between approximately 1.5 and 6 inches, and more specifically between approximately 2 and 5 inches. In one example aspect, the width W of the backboard 130 can be approximately 2.75 inches. Further, example dimensions of a depth D of the support panel 112 and backboard 130 can be between approximately 0.15 and 0.75 inches, and more specifically between approximately 0.2 and 0.5 inches. In one example aspect, the depth D can be approximately 0.25 inches. In other example aspects, the backboard 130 and support panel 112 can define differing depths. As will be appreciated by one skilled in the art, the various dimensions of the support panel 112, backboard 130, and rail 102 can be adjusted by the manufacturer as desired to meet the varying needs of consumers.

Figure 4:
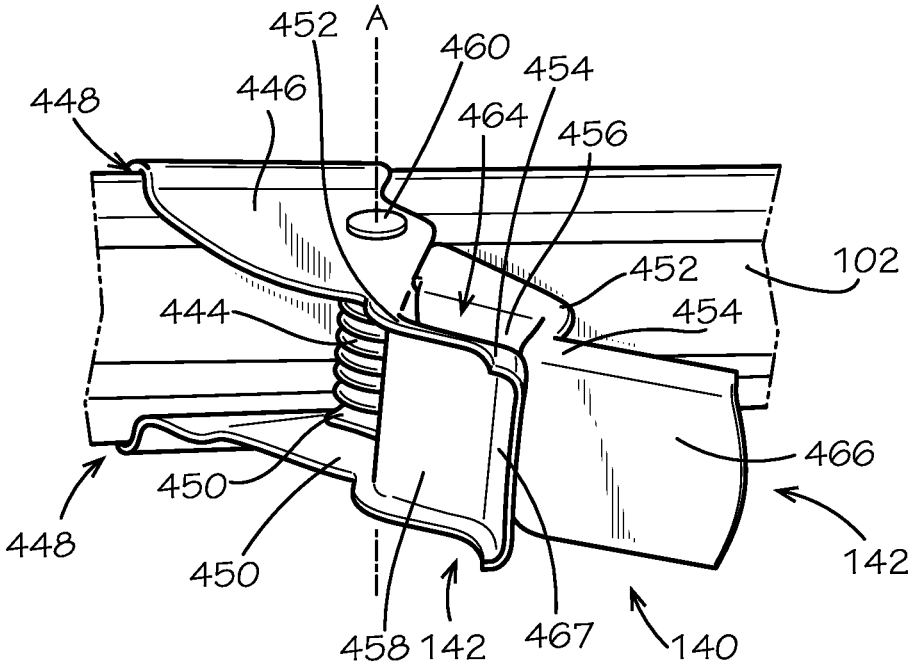
FIG. 4 is a perspective view of the grip of FIG. 1.

As shown, in FIG. 4, each of the clamps 140 can extend in a generally perpendicular direction from the rail 102. According to example aspects, each of the clamps 140 can define a base 446. The base 446 can comprise a pair of opposing grooves 448 configured to engage opposing edges of the rail 102. The base 446 can slide along the rail 102 to reposition the clamp 140 along the length of the rail 102. In some aspects, the clamp(s) 140 can be detached from the rail 102 by sliding the clamp(s) 140 off of one of the rail ends 106 (shown in FIG. 1). The pair of clamp halves 142 can extend from the base 446.

Each of the clamp halves 142 can comprise a first end 450, a second end 454, and a central section 452 therebetween. Further, each of the clamp halves 142 can define an inner surface 456 and an outer surface 458 opposite the inner surface 456. As shown, the clamp halves 142 can be oriented such that the inner surfaces 456 of the clamp halves 142 can face one another. The spring 444 can be positioned adjacent the first ends 450 of the clamp halves 142 and can engage each of the first ends 450 to bias the clamp halves 142 towards a closed position, as shown. According to example aspects, the spring 444 can be a helical torsion spring. In other aspects, the spring 444 can be another type of spring, such as, for example, a compression spring. Example aspects of the clamp 140 can further comprise an axle 460 that can extend through the center of the spring 444 and through openings (not shown) in the first ends 450 of the clamp halves 142. The axle 460 can define an axis A about which the clamp halves 142 can rotate. Moreover, example aspects of the central sections 452 can comprise a padding 862 (shown in FIG. 8) applied to the inner surfaces 456 thereof. The padding 862 can comprise a material such as, for example, rubber or plastic foam.

As shown, in the closed position, the clamp halves 142 can be biased towards one another, such that the first ends 450 can abut one another and the second ends 454 can abut one another. The central sections 452 of the clamp halves 142 can define a channel 464 therebetween. The channel 464 can be configured to receive a portion of one of the vials 170 (shown in FIG. 1), and in some aspects, the channel 464 can receive the neck 174 of the vial 170. The padding 862 applied to the inner surfaces 456 can engage the vial 170 and can aid in preventing movement of the vial 170 within the channel 464 of the clamp 140, as well as preventing damage to the vials 170, which often comprise glass.

Example aspects of the clamp 140 can further comprise a tab 466 extending from one or both of the clamp halves 142. In one example aspect, as shown in FIG. 4, an elongated tab 466 can extend from the second end 454 of a first one of the clamp halves 142. In some aspects, a shorter tab 467 can extend from the second end 454 of the other clamp half 142. To move the clamp 140 to an open position, a user can push against the inner surface 456 of the elongated tab 466, rotating the first one of the clamp halves 142 about the axle 460 and applying a twisting force to the torsion spring 444. As the first one of the clamp halves 142 rotates away from the second one of the clamp halves 142, the second ends 454 of the clamp halves 142 can be separated and the channel 464 between the central sections 452 can widen. The widened channel 464 between the central sections 452 can allow for easy insertion of a vial 170 into the channel 464. A user can then release the tab 466, and the spring 444 can bias the clamp halves 142 back to towards each other, clamping the vial 170 between the clamp halves 142. In some aspects, a vial 170 can be pushed against the tab(s) 466, 467 forcing the clamp halves 142 apart and allowing the vial to be pushed into the channel 464.

Figure 5:
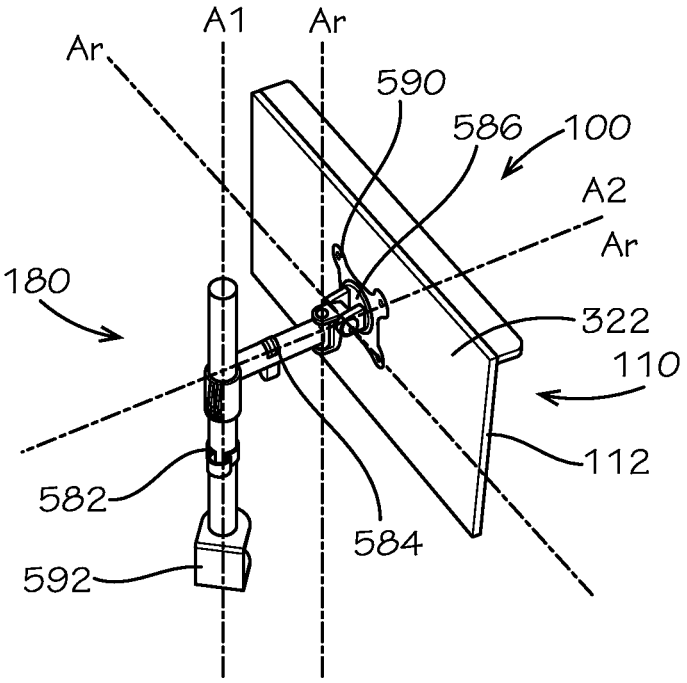
FIG. 5 is a perspective view of the medication holding device of FIG. 1 coupled to a support.
Figure 6:
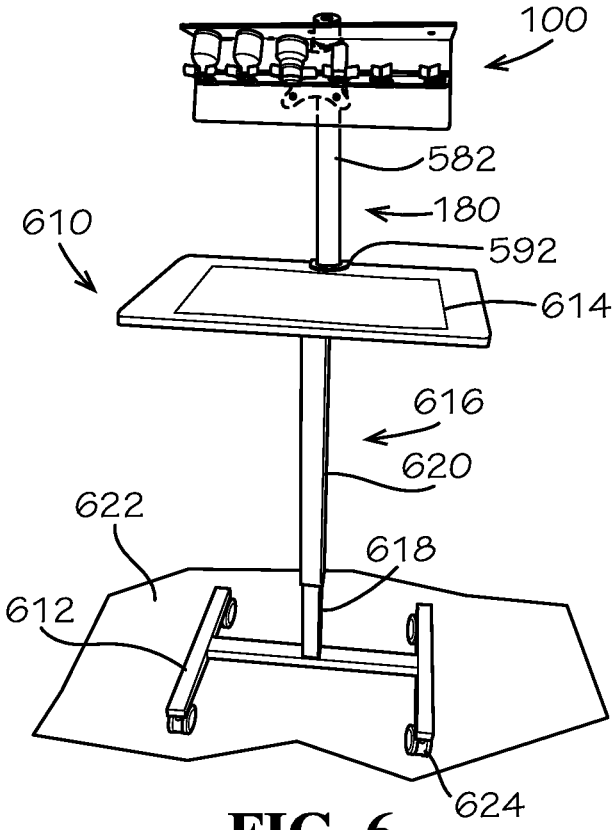
FIG. 6 is a front view of the medication holding device of FIG. 1 and support of FIG. 5 coupled to a table.

FIG. 5 illustrates the mount 110 coupled to the support 180. The support 180 can be configured to attach the medication holding device 100 to an object, such as, for example, a table 610 (as shown in FIG. 6), a hospital bed, a countertop, or any other suitable object for supporting and providing accessibility to the medication holding device 100. In other aspects, the medication holding device 100 can be directly attached to an object, such as, for example, a wall, a door, a cabinet, etc. As shown, example aspects of the support 180 can comprise a first arm 582 and a second arm 584 extending from the first arm 582. In example aspects, the first arm 582 can extend in a generally vertical direction and can define a generally vertical axis $A_1$, relative to the orientation shown. The second arm 584 can extend in a generally horizontal direction and can define a generally horizontal axis $A_2$, relative to the orientation shown. According to example aspects, the first arm 582 can extend through an opening (not shown) defined in the second arm 584, and the second arm 584 can slide along the first arm 582, such the second arm 584 can repositionable at varying heights along the first arm 582. In example aspects, the second arm 584 can also rotate with respect to the first arm 582 about vertical axis $A_1$. Further, in some aspects, one or both of the first and second arms 582, 584 can be adjustable in length.

As illustrated, the support can further comprise a bracket 586 coupled to the second arm 584. The bracket 586 can engage the back surface 322 of the support panel 112. The bracket 586 can be coupled to the support panel 112 via a fastener, such as, for example, screws 590. In other aspects, the fastener can be, for example, nails, adhesives, clips, or any other suitable fastener known in the art. Furthermore, the support panel 112 can be configured for movement with respect to the second arm 584. For example, in the depicted aspect, the support panel 112 can rotate with respect to the second arm 584 about various axes $A_r$. The adjustability of the support 180 and of the medication holding device 100 with respect to the support 180 can allow a user to position the medication holding device 100 in an optimal orientation. Example aspects of the support 180 further can comprise an attachment device 592, such as a C-shaped clip, as shown, for attaching the support 180 to an object, such as the table 610 shown in FIG. 6.

FIG. 6 illustrates the support 180 coupled to the table 610. According to example aspects the table 610 can comprise a base 612, a table top 614, and a leg 616 extending between the base 612 and the table top 614. The base 612 can be configured to rest on a support surface, such as a floor 622. The leg 616 can be coupled to and extend generally upward from the base 612, and can support the table top 614 above the floor 622. In example aspects, the attachment device 592 of the support 180 can engage the table top 614, and the first arm 582 of the support 180 can extend generally upward therefrom, relative to the orientation shown, to support the medication holding device 100 above the table top 614. Example aspects of the support 180 can be permanently or detachably coupled to the table 610.

As shown, according to example aspects, the table 610 can comprise one or more wheels 624 coupled to the base 612 to facilitate rolling of the table 610 and the medication holding device 100 across the floor 622. As such, the medication holding device 100 can easily be moved to a desired location in a room or between rooms in a medical facility. Further, example aspects of the leg 616 of the table 610 can be selectively height-adjustable. In one example aspect, as shown, the leg 616 can comprise a first leg section 618 that can be configured to telescope within a second leg section 620. Moreover, the table top 614 can provide a substantially flat, horizontal surface for supporting various medical accessories, such as gloves, a syringe, etc.

Figure 7:
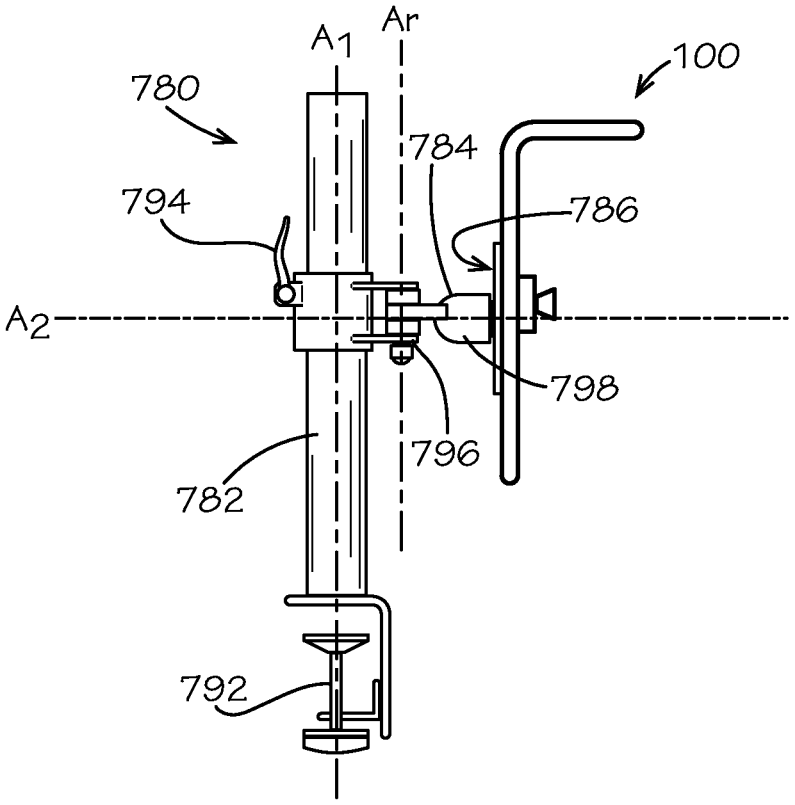
FIG. 7 is a side view of the medication holding device of FIG. 1 coupled to another example aspect of a support.

FIG. 7 illustrates the medication holding device 100 coupled to another example aspect of a support 780. As shown, the support 780 can comprise a first arm 782 and a second arm 784. The first arm 782 can extend in a generally vertical direction and can define a generally vertical axis $A_1$, relative to the orientation shown. The second arm 784 can extend from the first arm 782 in a generally horizontal direction and can define a generally horizontal axis $A_2$, relative to the orientation shown. Example aspects of the second arm 784 can be slidably engaged with the first arm 782, such that the second arm 784 can be repositioned along the length of the first arm 782. Additionally, example aspects of the second arm 784 can be rotatably engaged with the first arm 782, such that the second arm 784 can rotate about the axis $A_1$ defined by the first arm 782. According to example aspects, the support 780 can comprise a locking mechanism 794 for locking the second arm 784 in place with respect to the first arm 782. Furthermore, the second arm 784 can comprise a bracket 786 coupled to the medication holding device 100. Example aspects of the second arm 784 can also comprise a first pivot assembly 796 that can allow the medication holding device 100 to rotate about a first rotation axis $A_r$ and a second pivot assembly 798 that can allow the medication holding device 100 to rotate about a second rotation axis (going into the page). The support 780 can further comprise an attachment mechanism 792 coupled to the first arm 782 for attaching the medication holding device 100 to an object. In example aspects, the attachment mechanism 792 can be an C-clamp, as shown.

Figure 8:
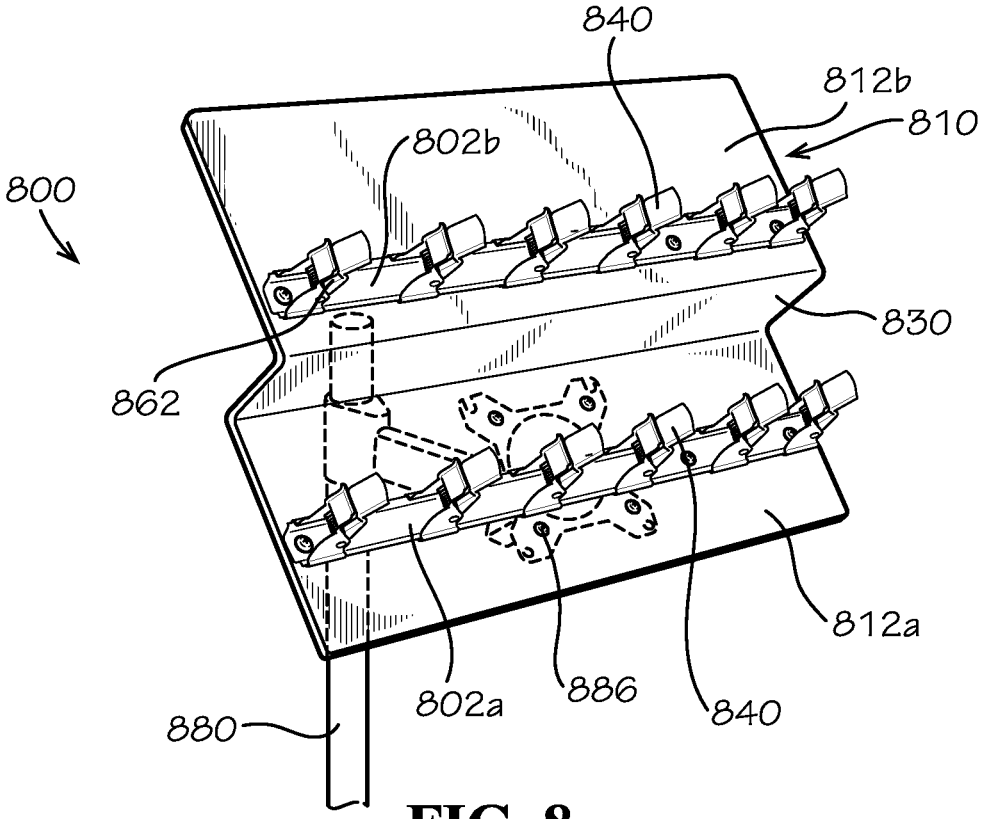
FIG. 8 is a perspective view of second example aspect of a medication holding device comprising a grip and a mount, in accordance with the present disclosure.

FIG. 8 illustrates another example aspect of a medication holding device 800. The medication holding device 800 can comprise a mount 810 and a plurality of clamps 840. The mount 810 can comprise pair of support panels 812*a,b* connected by a backboard 830. The medication device can further comprise a pair of rails 802*a,b*. Each one of the rails 802*a,b* can be coupled to one of the support panels 812*a,b*, respectively. Furthermore, as shown, one or more clamps 840 can be coupled to each of the rails 802*a,b*, and in example aspects, the one or more clamps 840 can be slidably and/or detachably coupled to the rails 802*a,b*. A bracket 886 of a support 880 can engage a first one of the support panels 812*a*. Such an assembly can increase the number of vials 170 (shown in FIG. 1) that can be held by the medication holding device 800 and can be beneficial in circumstances where a medical professional must administer many different types of medications.

Figure 9:
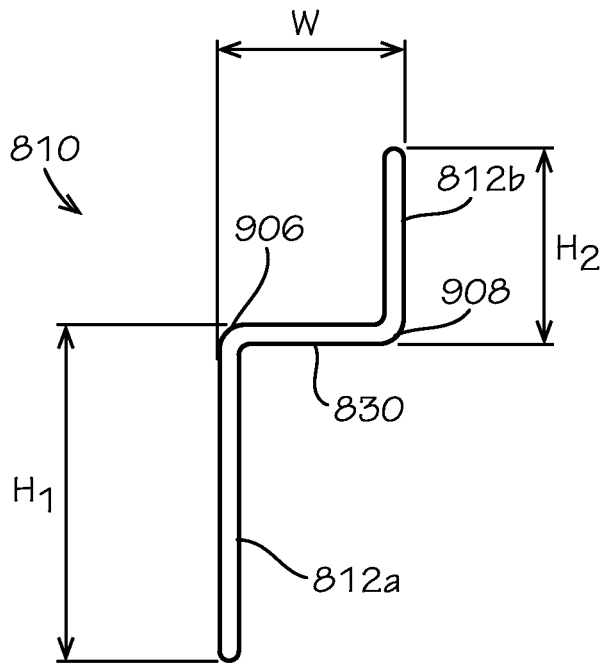
FIG. 9 is a side view of the mount of FIG. 8.

FIG. 9 illustrates a side view of the mount 810 of the medication holding device 100 of FIG. 8. As shown, a first one of the support panels 812*a* can extend generally downward from a back edge 906 of the backboard 830, relative to the orientation shown, and a second one of the support panels 812*b* can extend generally upward from a front edge 908 the backboard 830, relative to the orientation shown. Each of the support panels 812*a,b* can be oriented generally parallel to one another and can be oriented generally perpendicular to the backboard 830. An example height $H_1$ of a first one of the support panels 812*a* can be between approximately 2 and 10 inches, and more specifically can be between approximately 4 and 8 inches. In one example aspect, the height $H_1$ can be approximately 5.5 inches. An example height $H_2$ of the second one of the support panels 812*b* can be between approximately 2 and 10 inches, and more specifically can be between approximately 2 and 5 inches. In one example aspect, the height $H_2$ can be approximately 3 inches. Moreover, an example width W of the backboard 830 extending between the support panels 812*a,b* can be between approximately 1.5 and 6 inches, and more specifically can be between approximately 2 and 4 inches. In one example aspect, the width W can be approximately 2.75 inches.

Figure 10:
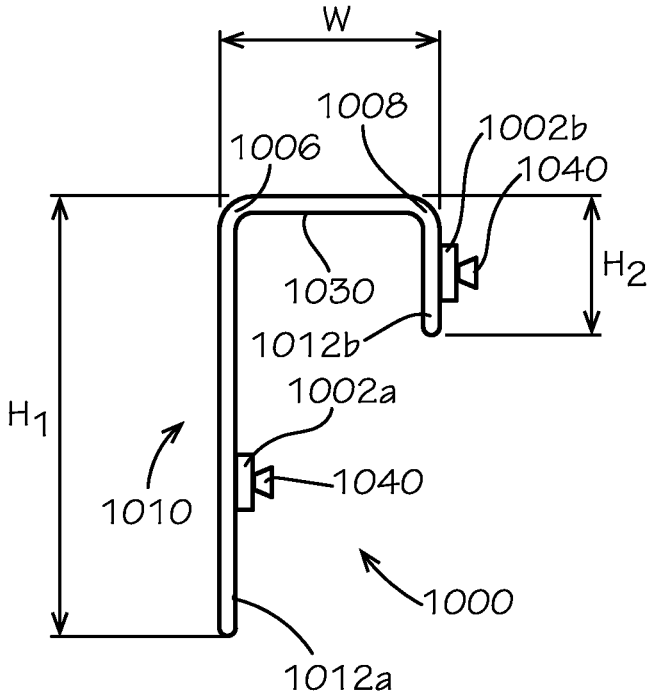
FIG. 10 is a side view of a third example aspect of a medication holding device, in accordance with the present disclosure.

FIG. 10 illustrates a side view of yet another example aspect of a medication holding device 1000. The medication holding device 1000 can comprise a mount 1010, and in example aspects, the mount 1010 can comprise a pair of support panels 1012*a,b* extending from a backboard 1030. As shown, relative to the orientation shown, a first one of the support panels 1012*a* can extend generally downward from a back edge 1006 of the backboard 1030, relative to the orientation shown, and a second one of the support panels 1012*b* can extend generally downward from a front edge 1008 of the backboard 1030, relative to the orientation shown. Each of the support panels 1012*a,b* can be oriented generally parallel to one another and can be oriented generally perpendicular to the backboard 1030. A rail 1002*a,b* can be coupled to each of the support panels 1012*a,b*, respectively, and a clamp 1040 can be coupled to each of the rails 1002*a,b*.

According to example aspects, the second one of the support panels 1012*b* extending from the front edge 1008 of the backboard 1030 can define a shorter height $H_2$ than the height $H_1$ of the first one of the support panels 1012*a* extending from the back edge 1006. An example height $H_1$ of the first one of the support panels 1012*a* can be between approximately 2 and 10 inches, and more specifically can be between approximately 5 and 8 inches. In one example aspect, the height $H_1$ can be approximately 6.5 inches. An example height $H_2$ of the second one of the support panels 1012*b* can be between approximately 2 and 10 inches, and more specifically can be between approximately 2 and 5 inches. In one example aspect, the height $H_2$ can be approximately 2.5 inches. Moreover, an example width W of the backboard 1030 extending between the support panels 1012*a,b* can be between approximately 1 and 7 inches, and more specifically can be between approximately 2 and 5 inches. In one example aspect, the width W can be approximately 3.25 inches.

A method of using the medication holding device 100 of FIGS. 1-7 can include separating the clamp halves 142 of one of the clamps 140 by applying a force to one or both of the clamp halves 142, inserting a vial 170 into the channel 464 of the clamp 140, and releasing the force on the one or both clamp halves 142 to secure the vial 170 in the clamp 140 in an inverted position. The method can further include inserting a needle (not shown) of a syringe (not shown) into the vial 170 and withdrawing medication from the vial 170. The medication holding devices 800, 1000 can be used in a substantially similar manner.

One should note that conditional language, such as, among others, "can," "could," "might," or "may," unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more particular embodiments or that one or more particular embodiments necessarily include logic for deciding, with or without user input or prompting, whether these features, elements and/or steps are included or are to be performed in any particular embodiment.

It should be emphasized that the above-described embodiments are merely possible examples of implementations, merely set forth for a clear understanding of the principles of the present disclosure. Any process descriptions or blocks in flow diagrams should be understood as representing modules, segments, or portions of code which include one or more executable instructions for implementing specific logical functions or steps in the process, and alternate implementations are included in which functions may not be included or executed at all, may be executed out of order from that shown or discussed, including substantially concurrently or in reverse order, depending on the functionality involved, as would be understood by those reasonably skilled in the art of the present disclosure. Many variations and modifications may be made to the above-described embodiment(s) without departing substantially from the spirit and principles of the present disclosure. Further, the scope of the present disclosure is intended to cover any and all combinations and sub-combinations of all elements, features, and aspects discussed above. All such modifications and variations are intended to be included herein within the scope of the present disclosure, and all possible claims to individual aspects or combinations of elements or steps are intended to be supported by the present disclosure.

That which is claimed is:

1. A medication holding device comprising:

a mount;

a grip coupled to the mount via a rail, the grip comprising a first clamp half and a second clamp half, each of the first and second clamp halves defining a first end, a second end, and a central section extending between the first end and the second end, the central sections defining a channel therebetween, a tab extending from the second end of the first clamp half and angled away from the second clamp half; and a support comprising an arm, wherein the mount is rotatably coupled to the arm, and wherein the mount is rotatable about a horizontal axis to tilt the mount upward and downward;

wherein the grip is movable between an open position and a closed position, the channel defining a first width in the closed position, the channel defining a second width in the open position that is greater than the first width, the grip configured to hold a vial of medication in an inverted position.

2. The medication holding device of claim 1, the grip comprising a spring, the spring biasing the grip to the closed position.

3. The medication holding device of claim 1, the mount comprising a support panel, the grip mounted to the support panel.

4. The medication holding device of claim 3, wherein:

the support panel defines an upper end and a lower end opposite the upper end;

the mount further comprises a backboard extending from the upper end of the support panel and obstructing access to the grip at the upper end; and access to the grip is unobstructed at the lower end of the support panel.

5. The medication device holding device of claim 1, the grip at least one of slidably and detachably coupled to the rail.

6. The medication holding device of claim 1, wherein the grip further defines a base, the base slidably mounted on the rail.

7. The medication holding device of claim 6, wherein the base defines a first groove, the first groove configured to engage and slide along a first edge of the rail.

8. The medication holding device of claim 7, wherein:

the base further defines a second groove opposite the first groove;

the rail further defines a second edge opposite the first edge; and the second groove is configured to engage and slide along the second edge.

9. The medication holding device of claim 1, the grip comprising a padding facing the channel, the padding comprising at least one of rubber and plastic foam.

10. The medication holding device of claim 1, further comprising a second mount and a second grip, the second mount coupled to the first mount, the second grip coupled to the second mount configured to grip a second vial of medication in an inverted position.

11. The medication holding device of claim 1, the mount comprising a support panel, a rail coupled to the mount, the grip coupled to the rail, the grip further comprising a spring, the spring biasing the first and second clamp halves towards one another, an axle extending through the spring, the first and second clamp halves pivotably coupled to the axle and movable between the open position and closed position.

12. The medication holding device of claim 1, each of the first and second clamp halves defining a central section, the channel defined between the central sections, the tab extending from the central section of the first clamp half, the first and second clamp halves configured to separate when a force is applied by a vial to the tab to allow the vial to be pushed into the channel.

13. The medication holding device of claim 1, further comprising a second grip coupled to the mount and configured for engaging a second vial of medication in an inverted position.

14. The medication holding device of claim 1, wherein the grip further comprises a tab extending from the second end of the second clamp half and angled away from the first clamp half.

15. The medication holding device of claim 14, wherein:

the tab extending from the first clamp half is an elongated tab; and the tab extending from the second clamp half is a shorter tab that is shorter than the elongated tab.

16. A medication holding device comprising:

a mount;

a rail secured to the mount and defining a first outer edge; and a grip comprising a first clamp half, a second clamp half, and a base mounted on the rail, each of the first and second clamp halves defining a first end, a second end, and a central section extending between the first end and the second end, the central sections defining a channel therebetween, a tab extending from the second end of the first clamp half and angled away from the second clamp half;

wherein the grip is movable between an open position and a closed position, the channel defining a first width in the closed position, the channel defining a second width in the open position that is greater than the first width, the grip configured to hold a vial of medication in an inverted position; and wherein the base of the grip wraps around the first outer edge of the rail.

17. The medication holding device of claim 16, wherein the base defines a first grip groove, the first outer edge of the rail received within the first grip groove.

18. The medication holding device of claim 17, wherein:

the rail further defines a second outer edge opposite the first outer edge;

the base of the grip further wraps around the second outer edge; and the base defines a second grip groove opposite the first grip groove, the second grip groove configured to receive the second outer edge.

19. The medication holding device of claim 16, wherein mount comprises a support panel defining a front panel surface, and wherein the rail is secured to the front panel surface.

20. The medication holding device of claim 16, wherein the grip is slidably mounted on the rail, the first outer edge of the rail slidable within the first grip groove of the base.

* * * * *